US005366273A

United States Patent [19]

Bresch

[11] Patent Number: 5,366,273

[45] Date of Patent: Nov. 22, 1994

[54] CHAIR OR THE LIKE

[76] Inventor: Gotthard Bresch, Am Berg 24, D-7077, Alfdorf, Germany

[21] Appl. No.: 15,176

[22] Filed: Feb. 10, 1993

[30] Foreign Application Priority Data

Feb. 11, 1992 [DE] Germany ..... 4236834

[51] Int. Cl.[5] ..... A47C 1/02

[52] U.S. Cl. ..... 297/316; 297/320; 297/284.2; 297/452.63

[58] Field of Search ..... 297/316, 284.2, 320, 297/321, 323, 340, 344.1, 452.63, 285

[56] References Cited

U.S. PATENT DOCUMENTS

| | | | |
|---|---|---|---|
| 293,813 | 2/1884 | St. John | 297/320 X |
| 2,648,372 | 8/1953 | Smith | 297/320 X |
| 3,175,269 | 3/1965 | Radrens et al. | 297/452.63 X |
| 3,203,734 | 8/1965 | Seymer | 297/452.63 |
| 3,271,076 | 9/1966 | Smith | 297/452.63 X |
| 4,545,614 | 10/1985 | Abu-Isa et al. | 297/284.2 |
| 4,828,320 | 5/1989 | Saiger | 297/452.63 X |
| 5,209,549 | 5/1993 | Chang | 297/320 |

FOREIGN PATENT DOCUMENTS

| | | | |
|---|---|---|---|
| 0167435 | 1/1986 | European Pat. Off. | 297/316 |
| 820474 | 9/1951 | Germany | 297/316 |
| 403282 | 1/1946 | Italy | 297/452.63 |
| 696110 | 5/1962 | Italy | 297/284.2 |

*Primary Examiner*—Laurie K. Cranmer
*Attorney, Agent, or Firm*—Edwin E. Greigg; Ronald E. Greigg

[57] ABSTRACT

A chair or the like with an undercarriage, having a seat surface that is attached in a resilient manner to the undercarriage and a backrest that is connected in a resilient manner to the seat surface, wherein to assure a flexible and individual conformity of the chair or the like to the body placing a load on it. A plurality of flexible strips are disposed next to one another and attached in their end area in a nearly horizontal orientation to the undercarriage which act as a seat surface, and wherein a plurality of strips disposed next to each other in a nearly perpendicular orientation act as a backrest and are connected with their one end area to a strip and with their other end to the seat surface.

27 Claims, 5 Drawing Sheets

CHAIR OR THE LIKE

PRIOR ART

The invention relates to a chair or the like as generically defined hereinafter.

It is known that, with these types of chairs or the like, comfort and healthy posture during sitting are often difficult to unify. The main cause of this is that most chairs or the like, regardless of whether they are upholstered, offer only one posture of the seated individual, and conform to only one body shape by means of following its contours. An unchanging posture is considered unpleasant, however, particularly during long periods of sitting. Even when the seat—hereinafter referred to as "seat surface"—and the backrest of this type of chair or the like can be adjusted, this only insufficiently addresses the problem because, all the same, flexible adaptation to different sitting positions is not provided; instead, a new adjustment of the seat and backrest is necessary each time.

Chairs or the like are also known that, to a certain degree, conform flexibly to different sitting positions of the user. In the simplest case, the backrest yields elastically when leaned against. This has the disadvantage, however, that when the user leans back, he involuntarily slides forward on the seat surface, thereby putting an excessive load on the spinal column and even damaging it over time.

Sliding forward can be avoided by lowering the seat surface in the back area as the backrest yields. Such lowering while under a load is attained with other known chairs or the like by means of a one-piece embodiment of seat surface and backrest, for example, wherein the seat surface is connected only in its front area to the undercarriage, and both the seat surface and the backrest are made of a material that yields elastically. In contrast, with another known chair or the like (European Patent Disclosure 0 259 214), a frame that encloses the seat surface is rotatably seated around a horizontal axis and is connected via a second axis of rotation to a backrest made of a flexible material that is supported on the other side on the undercarriage. Yielding of the backrest causes a deflection of the frame along an arc of a circle, and therefore causes a lowering of the rear section of the seat.

These known chairs or the like, however, have the disadvantage that a flexible conformity is only provided in one direction of motion, namely in the leaning direction against the backrest. A flexible conformity to lateral motions or displacement of tile load is not provided. Moreover, with chairs or the like that have flexible seat surfaces and flexible backrests, there is the danger that that seat support will become unstable when weight is shifted. In addition, chairs or the like that have axes of rotation are expensive to construct and tend to require repair.

ADVANTAGES OF THE INVENTION

In contrast, the chair or the like in accordance with the invention, has the advantage that a flexible conformity to the body posture is provided, not only in one direction of motion, but also in at least one further lateral direction of motion. The result of this is a sitting posture that is always comfortable, ergonomically sound and sturdy, both when the user is sitting upright and when he leans against the backrest and/or shifts his weight laterally. Through the use of a plurality of strips as a seat surface that are made of flexibly yielding material and are connected on one side to the undercarriage and the use of a plurality of strips connected to the seat surface strips for the backrest, individual conformity is assured because the greater the load on the strips, the more they yield. Because each seat surface strip is connected to the undercarriage individually and independently of the other strips, each seat surface strip can also yield individually under a load. Instead of single strips, a preformed plate can be used, into which slots can be incorporated from one side, or plastic in which slots are already molded; it is significant that the seat edge then consists of one piece.

In accordance with an advantageous embodiment of the invention, the backrest strip is disposed directly on a seat surface strip that pivots independently of it; this can also be effected by means of correspondingly shaping a continuous strip. Because of this, a yielding by each backrest strip while the user leans back leads simultaneously to a lowering of the connected seat surface strip, so that the user is prevented from sliding forward. During this, a lowering of the seat surface is only provided in the areas that actually bear a load, assuring a uniform, all-over support of the body. Two or more backrest strips can be connected, or, in accordance with an embodiment of the invention, specifically one backrest strip can be connected to one seat surface strip, as long as it is only assured that each seat surface strip can pivot independently of the other seat surface strips.

A further advantage of the chair or the like in accordance with the invention is that no rotating parts are required that are costly to manufacture and that tend to require repairs.

In accordance with a further advantageous embodiment of the invention, the backrest strips are also embodied to yield flexibly. This embodiment has the advantage that the backrest reshapes convexly when under a load, and the spinal column is supported by the lower back to provide a healthy posture.

In accordance with another advantageous embodiment of the invention, the attachment of the seat surface strips to the undercarriage is flexibly embodied. The flexible attachment can consist of a spring-loaded hinge, for instance, that is provided either for each strip or for all of the seat surface strips. By means of this attachment, the pivot range of the seat surface strips is advantageously enlarged, so that shorter strips can be used for smaller chairs or the like.

In accordance with another advantageous embodiment of the invention, the connection between seat surface strips and backrest strips is also flexibly embodied, in the shape of a spring-loaded hinge between the seat surface strip and the backrest strip, respectively, to enlarge the possible pivot range of the backrest strips here as well.

In accordance with another advantageous embodiment of the invention, strips that are narrow in relation to their length are used for both the seat surface and the backrest. By means of this, the conformity to the load is advantageously improved, because by doing this a large number of independently pivoting strips are present.

In accordance with another advantageous embodiment of the invention, the spacing of the backrest strips in the area of their connection to the seat surface strips is small, and increases toward the upper free end of the backrest strips. By means of this embodiment, the backrest is fanned out, so to speak, toward its upper end, resulting in an even better conformity.

In accordance with another advantageous embodiment of the invention, the two outer backrest strips, which laterally define the backrest, are rigidly connected to a great extent via a cross connection that extends crosswise with respect to them. By means of this, a lateral bracing of the backrest is advantageously achieved, and an excessive yielding by the backrest strips is prevented. At the same time, the cross connection acts as a guide for the straps on the inside as they pivot, in that these strips rest in a gliding manner against the cross connection when under a load.

In accordance with an advantageous feature of these characteristics, a flexible strip acts as a cross connection. By means of this, an excessive load on the cross connection and its attachment to the two outer backrest strips is prevented on the one hand and, on the other hand, a pivoting of the inner strips is assured. In order not to hamper the pivoting of the inner strips, the cross connection is additionally provided with a low-friction upper surface. A negative effect on the pivoting only occurs, therefore, under a very heavy load, which is also desirable in this case.

In accordance with an advantageous feature of these characteristics, the flexible strip is wide in relation to its thickness. Because of this, a high torsional strength is attained in connection with the pressure of the backrest strips lying against one another along with simultaneous good guidance for the inner backrest strips. In accordance with the invention, guiding means that engage the gaps between the backrest strips can be disposed on this strip.

In accordance with an advantageous feature of these characteristics, the cross connection is disposed near the transition between the seat surface and the backrest. This arrangement has proven to be particularly advantageous for attaining the correct degree of lateral bracing of the backrest. At the same time, a far deflection of the backrest strips perpendicularly to the backrest surface is possible.

In accordance with a further advantageous embodiment of the invention, the two outer seat surface strips that laterally define the seat surface are rigidly connected to a great extent via a cross connection extending perpendicularly with respect to them. By means of this, the backrest acquires satisfactory lateral stability, even with a very soft seat.

In accordance with another advantageous embodiment of the invention, a cross strut connected to the undercarriage or the seat and acting as a stop for the backrest strip is provided on the side of the backrest facing the seat surface. In the process the point of attack can be disposed to yield vertically, if necessary. By means of this stop, the maximum deflection of the strips can be limited, such as when an upright posture should be supported. At the same time, the piece of furniture is prevented from being destroyed under an excessive load.

In accordance with an advantageous feature of these characteristics, two lateral armrests attached to the undercarriage are present whose one end extends as far as the side of the backrest facing the seat surface and acts as a holder for the cross strut. This embodiment has the advantage that no additional component is required to hold the cross strut on the side of the backrest facing the seat surface. The cross strut is connected via the lateral armrests to the undercarriage, and therefore represents a fixed point opposite the pivoting backrest and the pivoting seat surface.

In accordance with an advantageous feature of these characteristics, the armrests are flexibly connected to the undercarriage. This prevents the destruction of the armrests under an excessive load, particularly in the area extending behind the backrest.

In accordance with another advantageous embodiment of the invention, the backrest strips are lengthened downward via the connection to the seat surface strips, and the cross strut is provided beneath the seat surface on the side of the backrest strip facing the seat surface. The stop is covered to a great extent because of this, and does not impair the appearance of the chair or the like.

In accordance with an advantageous feature of these characteristics, the distance between the cross strut and the backrest strips can be altered. By means of this embodiment, the maximum of the strips can be advantageously adjusted. Another option for adjusting the maximum deflection involves adjusting the height of the cross strut relative to the backrest. In this case, the cross strut can also be attached to the two outer backrest strips, because of which the deflection of the seat strips relative to the deflection of the backrest strips is less restricted.

In accordance with an advantageous feature of these characteristics, a flexible rod is privided as a cross strut. This embodiment has the advantage that, when the backrest strips come to rest against the cross strut, it is deformed in the shape of an arch, by means of which the backrest strips are additionally supported laterally, on the one hand and, on the other, a comfortable backrest shape as well as a seat surface shape result.

In accordance with a further advantageous embodiment of the invention, a guide acting on tile backrest strips is provided, by means of which the relative deflection of adjacent backrest strips is limited at least to tile extent that the backrest strips do not overlap in the area of their connection, but rather remain in a row next to each other. By means of this embodiment, the adjacent backrest strips are prevented from overlapping during varying deflection. Because of this, the backrest is always ensured to be a harmonically curved surface.

In accordance with an advantageous feature of these characteristics, the free ends of the backrest strips have cross guides, through which a flexible rod extends crosswise with respect to the backrest strips. By means of this embodiment, a suitable guidance of the backrest strips is provided that nonetheless allows an extensively free pivoting of the backrest strips and a lateral motion of the free ends of the backrest strips in the surface formed. By means of the flexibility of the rod, arching of the backrest is possible without the individual strips being able to move so far out of the common surface that overlapping of the strips is possible during strong deflection of a strip, a force is exerted on the adjacent strips, and they likewise are deflected, if only to a limited degree.

In accordance with another advantageous embodiment of the invention, the flexible rod has a low-friction upper surface and can be disposed in crosswise recesses, such as on the side facing or remote from the seat surface or in a crosswise opening of the backrest strips. This embodiment is particularly suited for keeping the backrest strips in a row in an upholstered chair or the like. The structural expenditure for this is very low.

In accordance with a further advantageous embodiment of the invention, a cross strip of only slight flexibility that is supported against the two outer backrest strips is provided in the area of the transition from the seat surface to the backrest, wherein the cross connection is movable at least in one of the holders in the direction of its longitudinal axis. This embodiment is also suited for keeping the backrest strips in a row next to each other, and a deflection of the backrest strips and the seat surface strips is slowed even less. This cross strip can be disposed at the same height as the rigid cross connection that connects the two outer backrest strips for lateral bracing.

In accordance with a further advantageous embodiment of the invention, means are present that damp the spring motion of the seat surface strips and backrest strips. In accordance with a preferred embodiment, a stiff support extends behind the seat surface and backrest connected to the undercarriage, and an insulating material is provided between the inflexible support and the flexible strips. By means of this embodiment, oscillations of the spring strips are slowed in an advantageous manner and subsequent oscillation is damped, which is particularly advantageous in the area of motor vehicles.

In accordance with another advantageous embodiment of the invention, the seat surface strips are embodied as double strips with two overlapping strips that form a pair of strips, which are connected via spacing means located between them. The advantage of this embodiment is that the strips at the top are particularly flexibly embodied, by means of which the seating comfort is increased. The seat surface strips on the bottom transfer the majority of the weight of the user to the undercarriage. By means of this, an essentially softer seat surface is attained, particularly in the front area.

In accordance with an advantageous feature of these characteristics, the strips of a pair of strips are rigidly connected via the spacing means. The effect of this embodiment is that the pairs of seat strips are not deflected in a simple curve, but instead in a slight S-shape, because only then so the lengths of the curve of both strips in a pair of strips match. The resulting advantage of this is that the backrest has nearly the same inclination during any arbitrary seating deflection with respect to the base of the chair or the like, or at least it inclines less toward the base than with nonrigid connections. The select,on of spacing means of varying measure allows the relative deflection of the backrest to the seat to vary.

In accordance with a further advantageous embodiment of the invention, means for adjusting the spacing and/or the relative position in the direction of their longitudinal axis of the strips of each pair of strips are provided on the side of the double strips remote from the backrest. This embodiment has the advantage that the flexibility of the seat and backrest is adjustable. When the upper strip position is raised, the back ends of bottom strips are pulled toward the front because of the upperward pressure on the upper strips therefore the inclination toward the backrest in the direction toward the seat surface changed. A forward motion of the upper strip shortens the length of the curve that is available to the lower strip. By means of this, the S-shape of the deflection is intensified.

In accordance with an advantageous feature of these characteristics, a pin, which is guided in a sliding manner in a bushing disposed on the lower strip, engages the upper strip, and means are provided for displacing and locking the pin in the bushing. By means of a pin oriented diagonally upward and forward, both an upward and forward displacement of the upper strip are possible. A suitable adjustment option of the flexibility of the seat and backrest, however, also comes about when pins extend parallel to the seat strips by means of the intensification of the S-shape caused by this arrangement. The pins preferably engage a cross strip connected to the front end of the upper strips. By means of this, only a small number of pins is required to adjust all of the upper strips simultaneously. In accordance with the invention, a spring can act parallel to this adjustment for automatic horizontal adjustment as the position of the user, i.e., the seating load, changes.

In accordance with an advantageous embodiment of the invention, wood acts as the material for the flexible strips; solid ash has proven to be particularly suited as material for the flexible strips. The chair or the like in accordance with the invention can, in accordance with advantageous embodiments of the invention, be embodied as a chair, chaise lounge, armchair or bench, and the strips can be provided with upholstery.

The embodiments on the backrest described above can also be used independently of the embodiment of the seat surface. The particular advantages, such as conformity to the human body, side bracing and adjustment to the deflection, are retained.

In accordance with a further embodiment of the invention, the outer backrest strips have an additional supportive spring force, and the two outer backrest strips can be supported via two crossing curved tightening strips. Other resilient bracings are also conceivable, such as a particular torsional effect of the outer rods, although not only the outermost rods, for generating a centering reaction force for the user as he leans back.

Further advantages and advantageous embodiments of the invention are to be taken from the following description, the drawings, and the claims.

DRAWINGS

An exemplary embodiment of the subject of the invention is shown with variants in the drawings and is described in further detail below. Shown are in:

FIG. 1 a side view of the chair or the like in accordance with the invention in a schematic representation;

FIG. 2 a general view of the chair or the like in perspective;

FIG. 3 a detailed view in perspective of the crossover area between the seat surface and the backrest;

FIG. 4 a detailed view in perspective of the upper part of the backrest;

FIG. 5 a side view of the seat and backrest of a chair or the like in accordance with the invention while not under a load;

FIG. 6 a side view of the seat and backrest of a chair or the like in accordance with the invention while under a load;

FIG. 7 a side view of the seat and backrest of a variant of the chair or the like in accordance with the invention while not under a load;

FIG. 8 a side view of the seat and backrest of this variant while under a load;

FIG. 9 a longitudinal section through the front part of the seat surface of the chair or the like of FIGS. 7 and 8;

FIG. 10 a section through the front part of the seat of a further variant of the chair or the like in accordance with the invention;

FIG. 11 is a side view of a chair illustrating a cushion 24 on the flexible strips.

DESCRIPTION OF THE EXEMPLARY EMBODIMENT

Figure 1:
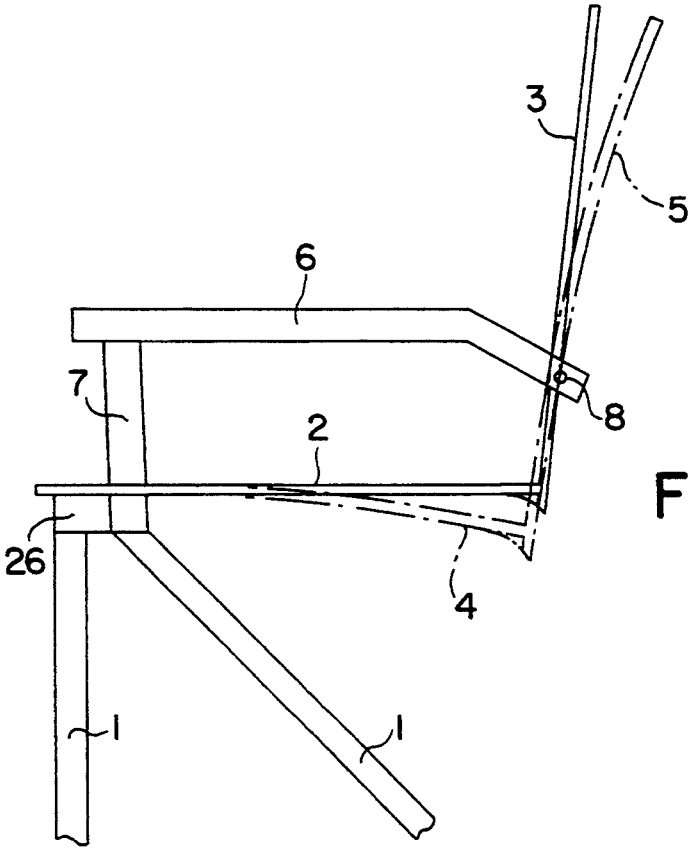
Figure 2:
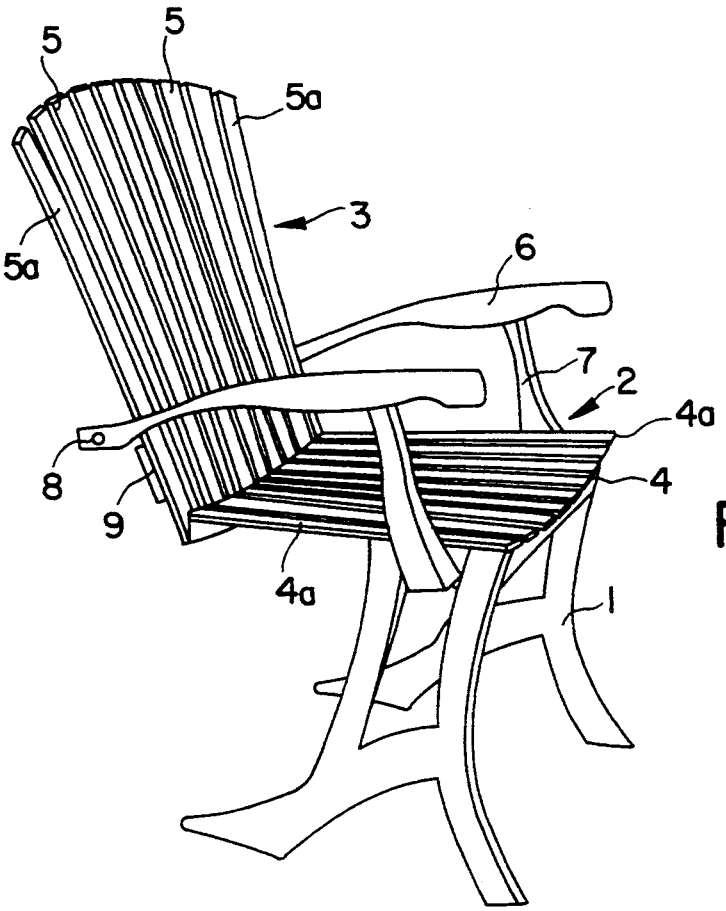

As shown in FIGS. 1 and 2, the chair or the like in accordance with the invention has an undercarriage 1, a seat surface 2 connected in a resilient manner to the undercarriage 1 and a backrest 3 connected ill a resilient manner to the seat surface. The seat surface 2 is formed by flexible, narrow strips 4 attached with their one end to a supporting cross piece 26 of the undercarriage 1, and the backrest by the same strips 5, and each backrest strip 5 is rigidly connected to a seat surface strip 4. Two armrests 6 that are connected to the undercarriage 1 via supports 7 and extend to the side of the backrest 3 remote from the seat surface 2 are located laterally above the seat surface 2.

Figure 3:
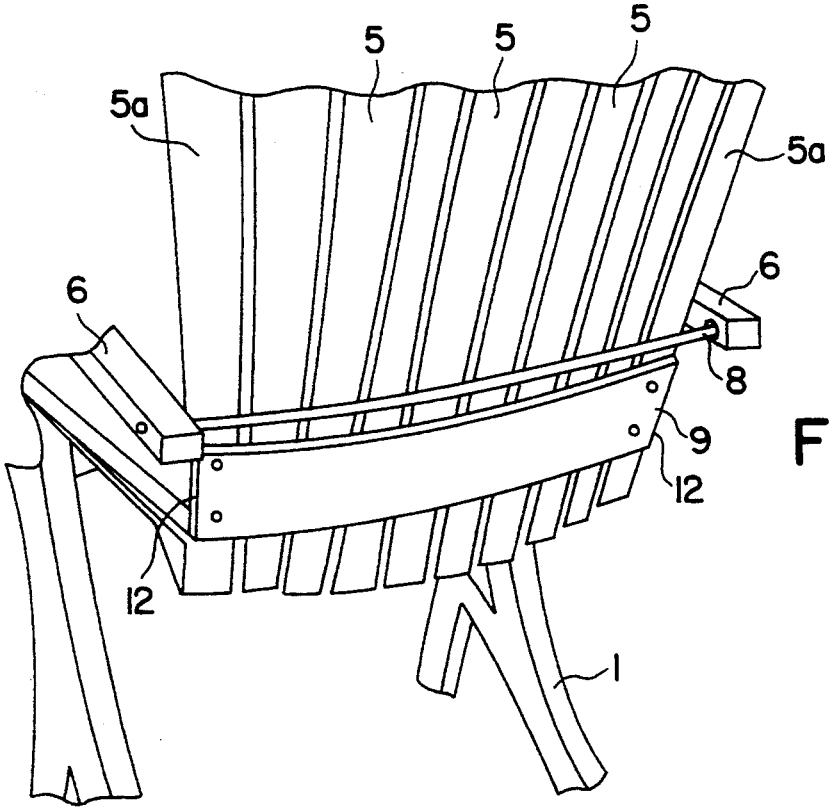

The ends of the armrests 6 located on the ends of the side of the backrest remote from the seat surface 2 act, as can be seen in FIG. 3, as holders for a flexible rod 8, which serves as a stop for the backrest strips 5. A flexible strip 9 that to a large extent connects the two outer backrest strips rigidly with each other is likewise present on the side of the backrest 3 remote from the seat surface 2.

Figure 4:
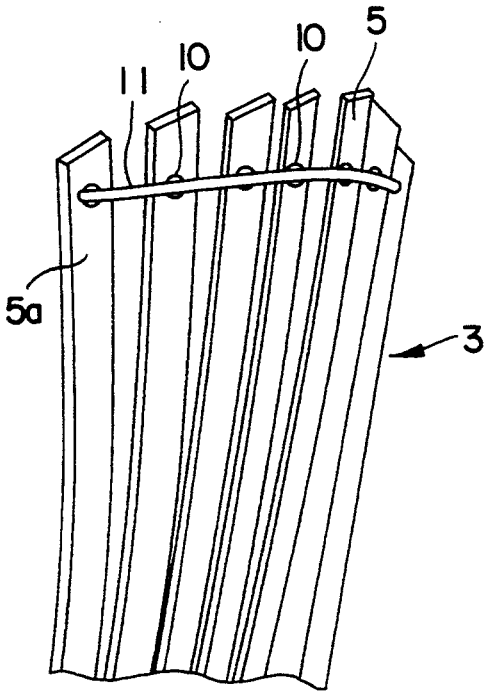
Figure 6:
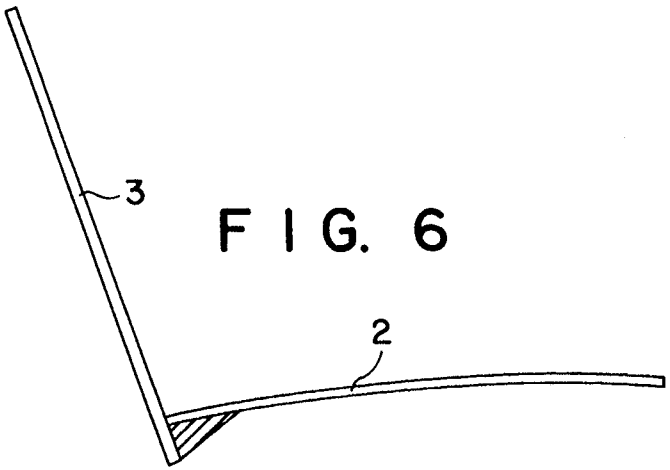
Figure 8:
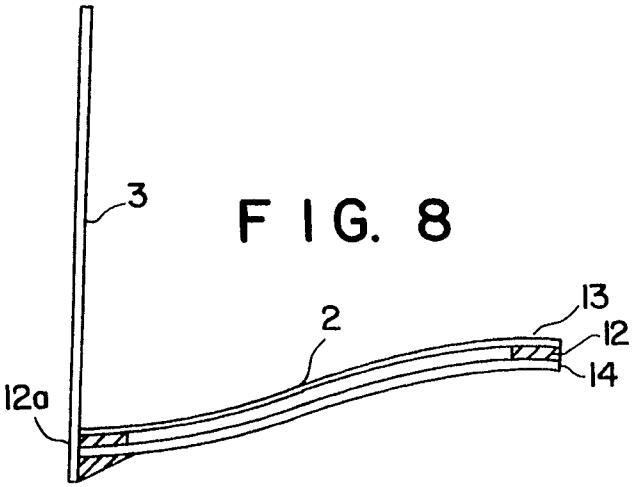
Figure 5:
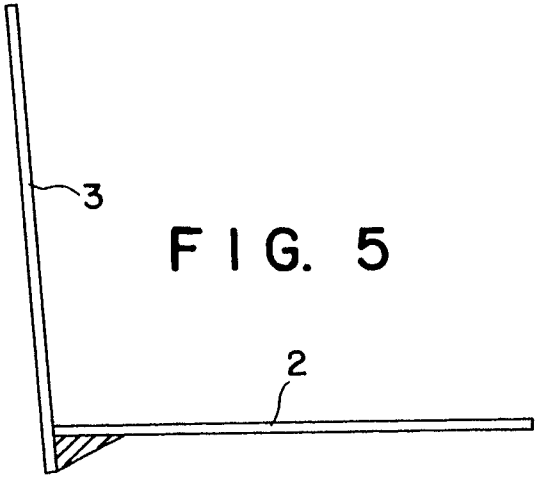
Figure 7:
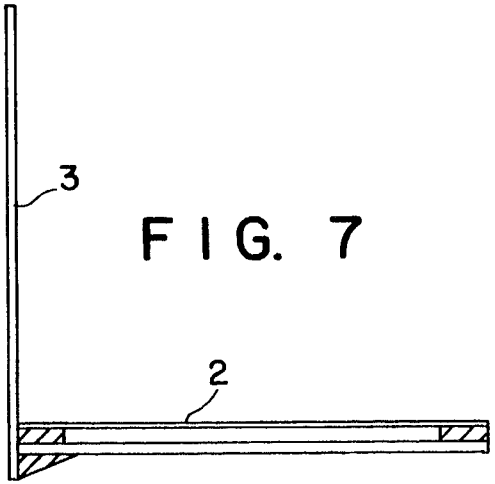

As can be seen in FIG. 4, the free ends of the backrest strips 5 have cross guides 10, through which a flexible rod 11 extending diagonally to the backrest strips 5 is guided.

In FIG. 1, the deflection of an individual seat surface strip 2 and the backrest strip 5 rigidly connected to it is shown under a load in dashed lines. A load on the seat surface 2 leads directly, while a load on the backrest 3 leads indirectly, to the lowering of the seat surface 2 in the direction to the contact surface of the chair or the like. In addition, a result of the flexible embodiment of the backrest strips 5 is a convex shape of the backrest strips 5 while under a load, by means of which the spinal column of the user is positively supported.

A sideways tipping of the backrest 3 and therefore a torsion of the seat surface strips 4 are prevented by means of the cross strip 9 shown in FIG. 3. The rod 8 shown in FIG. 3 serves as a stop for the backrest 3 in order to limit the maximum deflection of the backrest 3 and thus of the seat surface 2. The rod 8 is connected to the undercarriage 1 via the armrests 6, but not to the backrest strips 5, assuring the free pivoting of all strips 4 and 5.

A guide is provided on the free ends of the backrest strips 5 so that the backrest strips 5 cannot overlap under varying loads, at least in the area of the connection to the seat surface strips 4, as shown in FIG. 4. The free pivoting of the backrest strips 5 is only limited to an insignificant extent by this.

The effect on the inclination of the backrest 3 of the use of double strips 13, 14 in the seat surface can be seen in FIGS. 5 through 8. When the seat surface 2 is under a load, the backrest 3 inclines far backward if a single strip is provided, while it remains nearly unchanged with the use of double strips, which are rigidly connected to one another via spacing means 12, 12*a*.

Figure 9:
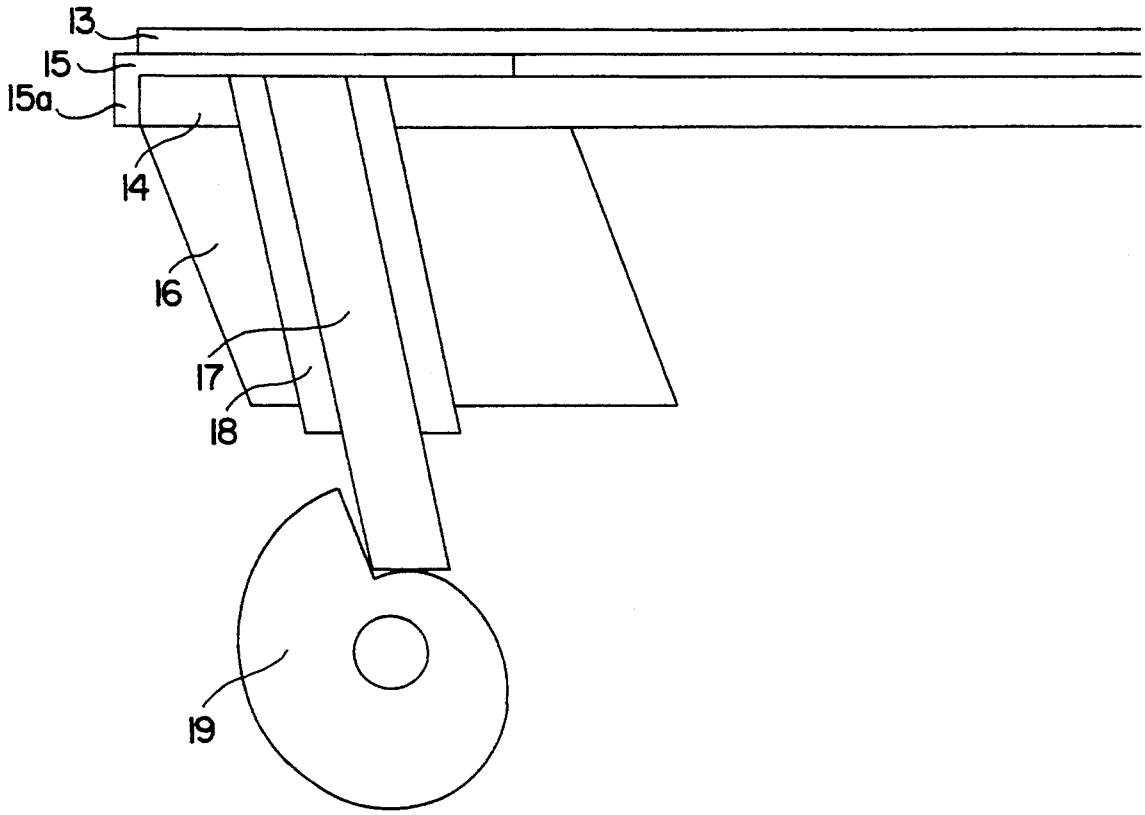

FIG. 9 shows the embodiment of a device for changing the flexibility of the seat and backrest. The upper strips 13 are connected at their forward end to the lower strips 14 via a cross strut 15 engaged at both ends by a round pin 17, and which is guided in a sliding manner in a bushing 18. The bushing 18 is disposed in a second cross strut 16 attached to the lower strips 14. The round pin 17 and slide bushing 18 are oriented diagonally upward and forward. The second end of the round pin 17 is seated on a rotatably seated endless screw, By means of the rotation of the endless screw 19, the pin 17 is pressed against the cross strut 15 and pulls the upper strip position 13 both upward and forward relative to the bottom strips 14. By means of this, the flexibility of the seat surface strips 13, 14 is increased and the S-shape is intensified.

Figure 10:
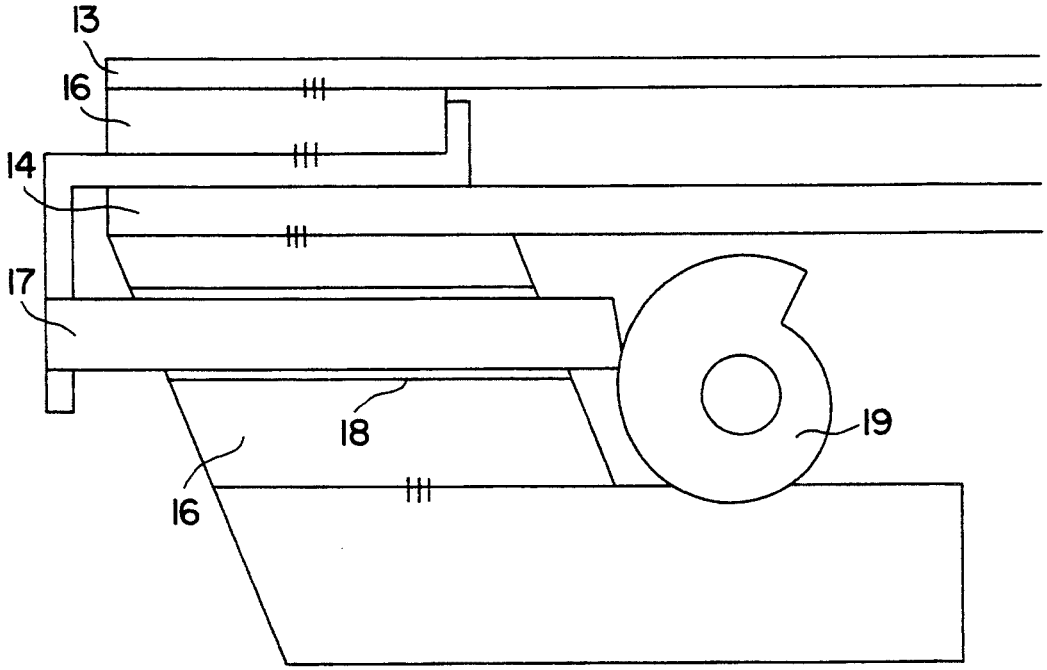

FIG. 10 shows a variant of this adjustment device with which the pin 17 extends parallel to the seat surface strips 13, 14 and is movable in their longitudinal direction. By means of this, the flexibility of the surfaces of the seat and backrest can be varied to a great extent.

Figure 11:
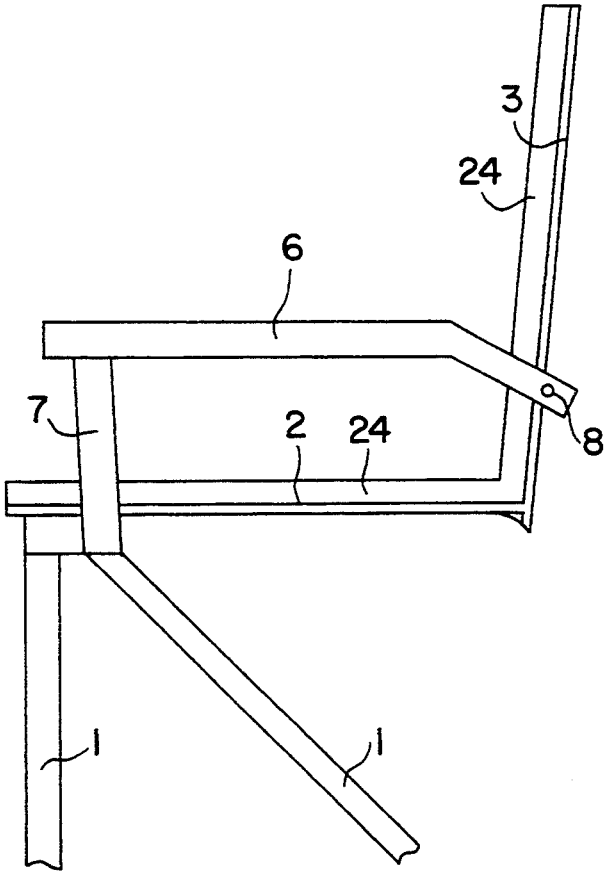

The chair or the like in accordance with the invention is preferably manufactured from wood, particularly ash, and requires no hinges. The strips 4 and 5 can be provided with a cushion 24 as shown in FIG. 11 to increase the comfort of the chair or the like in accordance with the invention. The flexibility of the chair or the like in accordance with the invention can be adjusted by means of the exchange of the rod 8 for a more inflexible rod, just as by changing the spacing of this rod 8 from the backrest strips 5 . The chair or the like in accordance with the invention can thus be used as a work chair as well as a comfortable armchair, simply in that the stop 8 must be changed.

FIG. 11 is a side view of a chair illustrating a cushion 24 for the seat and backrest.

All features represented in the description, the following claims and the drawings can be essential to the invention both individually and in arbitrary combination with one another.

I claim:

1. A chair with an undercarriage (1), having a seat surface (2) that is connected only with its front end in a resilient manner to the undercarriage and a backrest (3) connected in a resilient manner to the back of the seat surface (2), said seat surface is formed by a plurality of flexible seat strips (4) disposed next to one another and attached in a front end area in a nearly horizontal orientation to the undercarriage (1) and perform as a seat surface (2), and that a plurality of backrest strips (5) disposed next to each other in a nearly perpendicular orientation relative to said flexible seat strips (4) act as a backrest (3), each said backrest strip (5) has one end directly connected to an end area of a corresponding flexible seat strip (4) of the seat surface (2) and with an upper free end facing away from the seat surface (2).

2. The chair as defined by claim 1, in which said seat strips (4) and said backrest strips (5) are narrow in relation to their length act as a seat surface (2), and that similar strips (5) that are narrow in relation to their length, function as a backrest.

3. The chair as defined by claim 1, in which the spacing of the strips (5) of the backrest (3) in an area of their connection to the seat surface strips (4) is small and increases toward upper, free ends of the strips (5).

4. The chair as defined by claim 1, in which two outermost backrest strips (5*a*) that laterally define the backrest (3) are rigidly connected via a cross connection (9) that extends crosswise with respect to the two outermost backrest strips.

5. The chair as defined by claim 4, in which the cross connection (9) is embodied as a flexible strip and is wide in relation to its thickness.

6. The chair as defined by claim 1, in which a cross connection (9) is disposed near a transition of the seat surface (2) to the backrest (3).

7. The chair as defined by claim 1, which includes two outer seat surface strips (4*a*), said two outer seat surface strips (4*a*) of the seat surface strips (4) that laterally define the seat surface (2) are rigidly connected via a cross connection that extends crosswise with respect to said seat surface strips.

8. The chair as defined by claim 7, in which a flexible rod acts as a cross strut (8).

9. The chair as defined by claim 1, in which a guide acting on the backrest strips (5) is provided, through which the relative deflection of adjacent backrest strips (5) is at least limited insofar as the backrest strips (5) do not overlap in an area of their connection, but remain in a row next to each other.

10. The chair as defined by claim 9, in which a cross strip with a low flexural strength that is maintained in a holder against two outer backrest strips is provided in the area of the connection of the backrest (3) to the seat surface (2), and the cross strip is movable in at least one of the two holders in the direction of its longitudinal axis.

11. The chair as defined by claim 1, in which the seat surface strips (4) are embodied as double strips (13, 14) with two overlapping strips (13, 14) forming a pair of strips, which are connected via spacing means (12, 12*a*) disposed between them.

12. The chair as defined by claim 11, in which the strips (13, 14) of a pair of strips are rigidly connected via the spacing means (12, 12*a*).

13. The chair as defined by claim 12, in which means are provided on a side of the strips (13, 14) remote from the backrest (3) for adjusting the spacing between the two strips (13, 14) that form a pair of strips and the relative position in the longitudinal direction of the strips (13, 14) of at least one pair of strips.

14. The chair as defined by claim 13, in which a pin (17) that is guided in a sliding manner in a bushing (18) is connected to a lower strip (14), the pin (17) has a portion that engages an upper strip (13) of the two strips (13, 14) forming a pair of strips, and that means (19) are present for displacing and locking the pin (17) in the bushing (18).

15. The chair as defined by claim 14, in which a cross strut (8) is located on the front end of the upper strip (13) that simultaneously transfers the motion of the pin to all upper strips (13).

16. The chair as defined by claim 1, in which wood, laminated wood or ash wood serves as material for the flexible strips (4, 5).

17. The chair as defined by claim 1, in which the chair is embodied as a chair or armchair.

18. The chair as defined by claim 1, in which the chair is embodied as a bench.

19. The chair as defined by claim 1, in which the flexible strips (4, 5) are provided with a cushion.

20. The chair as defined by claim 1, in which a cross strut (8) connected to the undercarriage (1) or the seat is engaged by the backrest strips (5) on a side remote from the seat surface (2) and acts as a stop for the backrest strip (5).

21. The chair as defined by claim 13, in which two lateral armrests (6) attached to the undercarriage (1) are provided whose one end is extended as far as the side of the backrest (3) remote from the seat surface (2) and acts as a holder for the cross strut (8).

22. The chair as defined by claim 13, in which the distance between the cross strut (8) and the backrest strips (5) is adjustable.

23. The chair as defined by claim 13, in which the cross strut (8) is displaceable in the longitudinal direction of the backrest strips (5).

24. The chair as defined by claim 18, in which a stop means for said backrest strip is provided on two outer backrest strips (5*a*), which act together with a device fixedly attached to the undercarriage to limit the maximum deflection of the seat strips.

25. The chair as defined by claim 24, in which connecting means (10) are provided near the free ends on the backrest strips (5) through which a flexible rod (11) extending crosswise with respect to the backrest strips (5) are guided.

26. The chair as defined by claim 22, in which the flexible rod has a low-friction upper surface and is disposed in crosswise recesses of the backrest strips that act as guides.

27. The chair as defined by claim 26, in which a thin spring steel sheet acts as a guiding means.

* * * * *

UNITED STATES PATENT AND TRADEMARK OFFICE

CERTIFICATE OF CORRECTION

PATENT NO. : 5,366,273

DATED : November 22, 1994

INVENTOR(S) : Gotthard Bresch

It is certified that error appears in the above-identified patent and that said Letters Patent is hereby corrected as shown below:

On the title page: Item

--[30] Foreign Application Priority Data

November 2, 1992 [DE] Germany.....4236834--

Signed and Sealed this

Thirty-first Day of January, 1995

*Attest:*

Bruce Lehman

BRUCE LEHMAN

*Attesting Officer*

*Commissioner of Patents and Trademarks*